US011214285B2

(12) United States Patent
Chiu

(10) Patent No.: US 11,214,285 B2
(45) Date of Patent: Jan. 4, 2022

(54) TRACK SWITCHING APPARATUS FOR RAIL TROLLEYS

(71) Applicant: TIEN HENG MACHINERY CO., LTD., Chia Yi Hsien (TW)

(72) Inventor: Te-Yi Chiu, Chiayi (TW)

(73) Assignee: Tien Heng Machinery Co., Ltd., Chia-Yi Hsien (TW)

( * ) Notice: Subject to any disclaimer, the term of this patent is extended or adjusted under 35 U.S.C. 154(b) by 442 days.

(21) Appl. No.: 16/277,076

(22) Filed: Feb. 15, 2019

(65) Prior Publication Data

US 2020/0262456 A1 Aug. 20, 2020

(51) Int. Cl.

| | |
|---|---|
| ***B61L 5/02*** | (2006.01) |
| ***B61L 5/04*** | (2006.01) |
| ***B61L 5/06*** | (2006.01) |

(52) U.S. Cl.

CPC ..... *B61L 5/026* (2013.01); *B61L 5/04* (2013.01); *B61L 5/065* (2013.01)

(58) Field of Classification Search

CPC .... B61L 5/026; B61L 5/04; B61L 5/00; B61L 5/02; B61L 5/023; B61L 5/045; B61L 5/06; B61L 5/065; B61L 5/08; B61L 5/10; B61L 5/107; E01B 25/12; E01B 25/00–34; E01B 26/00; E01B 26/005; E01B 2202/025; E01B 2202/04–048; E01B 23/06; E01B 7/02

USPC ..... 191/38, 32, 36, 40; 104/88.01, 96, 102, 104/130.01, 130.06

See application file for complete search history.

(56) References Cited

U.S. PATENT DOCUMENTS

| | | | | |
|---|---|---|---|---|
| 5,482,231 | A * | 1/1996 | Turner | E01B 7/02 246/415 R |
| 5,582,371 | A * | 12/1996 | Humphrey | E01B 7/02 238/338 |
| 10,179,978 | B2 * | 1/2019 | Schenk | E01B 23/06 |
| 2010/0000440 | A1 * | 1/2010 | Meinzinger | E01B 7/00 104/102 |
| 2012/0273624 | A1 * | 11/2012 | Meinzinger | E01B 7/00 246/122 R |

* cited by examiner

*Primary Examiner* — Zachary L Kuhfuss
*Assistant Examiner* — Cheng Lin
(74) *Attorney, Agent, or Firm* — Rosenberg, Klein & Lee

(57) ABSTRACT

The present invention relates to a track switching apparatus for rail trolleys. It comprises at least one linear track, a curved track connected to the at least one linear track, at least one switching region formed at a connection region of the linear track and the curved track, and at least one switching unit disposed in the at least one switching region.

9 Claims, 7 Drawing Sheets

TRACK SWITCHING APPARATUS FOR RAIL TROLLEYS

BACKGROUND OF THE INVENTION

1. Field of the Invention

The present invention relates to a track switching apparatus for rail trolleys which has a linear track and a curved track to switch a track type in response to peak and off peak hours for cargo transportation so as to regulate a number of the rail trolleys on the track, recycle the rail trolleys without cargo, increase cargo transportation volume, and increase transportation efficiency.

2. Description of Related Art

A rail trolley is usually used in transporting cargos for a long distance or transporting cargos. A cargo transportation track is built on the ground of a transporting route for cargo transportation by the rail trolley sliding back and forth on the track. In response to peak and off peak hours for cargo transportation, a switching apparatus is installed on the cargo transportation track to regulate a number of the rail trolleys on the cargo transportation track.

The conventional switching apparatus for a rail trolley switches the cargo transportation track in a linear manner with a longitudinal direction and a horizontal direction. However, arrangement of longitudinal tracks and horizontal tracks is not suitable for many factory building, and a curved track for the rail trolley is needed for matching an environmental terrain of the factory buildings to use a space of the factory building efficiently. Accordingly, the conventional switching apparatus that switches the linear track longitudinally and horizontally hardly meets a requirement for an actually work.

SUMMARY OF THE INVENTION

The present invention provides a track switching apparatus for rail trolleys which comprises at least one linear track and a curved track to switch track type in response to peak and off peak hours for cargo transportation so as to regulate a number of the rail trolleys on the cargo transportation track, recycle the rail trolleys without cargo, increase cargo transportation volume, and increase transportation efficiency.

The track switching apparatus for rail trolleys of the present invention comprises at least one linear track, a curved track, at least one switching region and a first switching unit. Accordingly, the linear track and the curved track is arranged according to an environmental terrain of a factory building, and the track type is switched by the at least one switching region and the switching unit in response to peak and off peak hours for cargo transportation so as to regulate a number of the rail trolleys on the track, recycle the rail trolleys without cargo, increase cargo transportation volume, and increase transportation efficiency.

The track switching apparatus for rail trolleys of the present invention comprises at least one linear track, a curved track, a first switching region and a first switching unit.

The at least one linear track has a first power transmission rail strip and a first supporting rail strip parallel to the first power transmission rail strip.

The curved track is connected to the at least one linear track and has a second power transmission rail strip and a second supporting rail strip parallel to the second power transmission rail strip.

The first switching region is formed at a connection region of the first power transmission rail strip of the linear track and the second power transmission rail strip of the curved track.

The first switching unit is disposed in the first switching region and has a first base station, at least one first sliding rail, a first sliding seat, a first movement power source, a first connection segment and a second connection segment. The at least one first sliding rail is disposed on the first base station. The first sliding seat is disposed slidably on the first base station. The first movement power source has a first transmission part for connecting the first sliding seat. The first connection segment has a linear shape for actively connecting to or separating from the first power transmission rail strip of the linear track. The second connection segment has a curved shape and is disposed on the first sliding seat at an interval for actively connecting to or separating from the second power transmission rail strip of the curved track.

According to an embodiment of the present invention, at least one side of an intersection of the first supporting rail strip of the linear track and the second power transmission rail strip of the curved track is provided with a second switching region, and the second switching region is further provided with a second switching unit having a second base station, at least one second linear sliding rail, a second movement power source and a third connection segment. The at least one second linear sliding rail disposed on the second base station, the second sliding seat is disposed slidably on the at least one second linear sliding rail, the second movement power source is disposed on the second base station and having a second transmission part connected to the second sliding seat, and the third connection segment is disposed on the second sliding seat for actively connecting to or separating from the first supporting rail strip of the linear track.

According to an embodiment of the present invention, two sides of the intersection of the first support rail strip of the linear track and the second power transmission rail strip of the curved track are provided with two second switching regions respectively, and each of the two second switching regions is provided with the second switching unit.

According to an embodiment of the present invention, the present invention further comprises plural first guide wheel assemblies. Each of plural first guide wheel assemblies has a first fixing seat and connects to an end bottom region of the first supporting rail strip of the linear track adjacent to the second switching region. The first fixing seat of each of the plural first guide wheel assemblies is further provided with a stand at a bottom and at least one first sliding rail press reducing gear disposed at one lateral of the first fixing seat. The first sliding rail press reducing gear is protruded from the second switching region for attaching to or detaching from a bottom of the third connection segment.

According to an embodiment of the present invention, each of the plural first guide wheel assemblies is further provided with a positioning seat connected to an end lateral region of the first supporting rail strip of the linear track adjacent to the second switching region. The positioning seat of each of the plural first guide wheel assemblies is further provided with a positioning wheel disposed at one lateral thereof and protruded from the second switching region for attaching to or detaching from a lateral of the third connection segment.

According to an embodiment of the present invention, the present invention further comprises plural stands. Each of the plural stands has a base, an assembly seat disposed on the base, and a lifting module disposed between the base and the assembly seat for connection. The assembly seat of each of the plural stands is for connecting a bottom of each of the first power transmission rail strip and the first supporting rail strip of the linear track, the second power transmission rail strip and the second supporting rail strip of the curved track, the first base station of the first switching unit, or the second base station of the second switching unit.

According to an embodiment of the present invention, the lifting module of the stand comprises at least one screw having one end fixed to the base and at least one screw nut for screwing to the at least one screw. The assembly seat comprises at least one locking hole at a bottom thereof for an insertion of the at least one screw, and each of the at least one screw is screwed to two screw nuts for locking and fixing at an upper side and a lower side of the bottom of the assembly seat respectively.

According to an embodiment of the present invention, the present invention further comprises plural stands, each of which has a base, an assembly seat disposed on the base and a lifting module disposed between the base and the assembly seat for connection. The assembly seat of each of the plural stands is respectively connected to a bottom of each of the first power transmission rail strip and the first supporting rail strip of the linear track, the second power transmission rail strip and the second supporting rail strip of the curved track, and a bottom of the first base station of the first switching unit.

According to an embodiment of the present invention, the present invention further comprises plural second guide wheel assemblies. Each of the plural second guide wheel assemblies has a second fixing seat and at least one second sliding rail press reducing gear disposed at one lateral of the second fixing seat and protruded from the first switching region for attaching to or detaching from a bottom of the first connection segment or a bottom of the second connection segment. Each of an end bottom region of the first power transmission rail strip and an end bottom region of the second power transmission rail strip is connected to the second fixing seat, and the second fixing seat of each of the plural second guide wheel assemblies is further provided with a stand at a bottom thereof.

According to an embodiment of the present invention, the curved track is disposed between two linear tracks parallel to each other and connected to the two linear tracks by two terminals thereof.

DETAILED DESCRIPTION OF THE PREFERRED EMBODIMENT

To provide a thorough understanding, the purpose and advantages of the present invention will be described in detail with reference to the accompany drawings.

Figure 1:
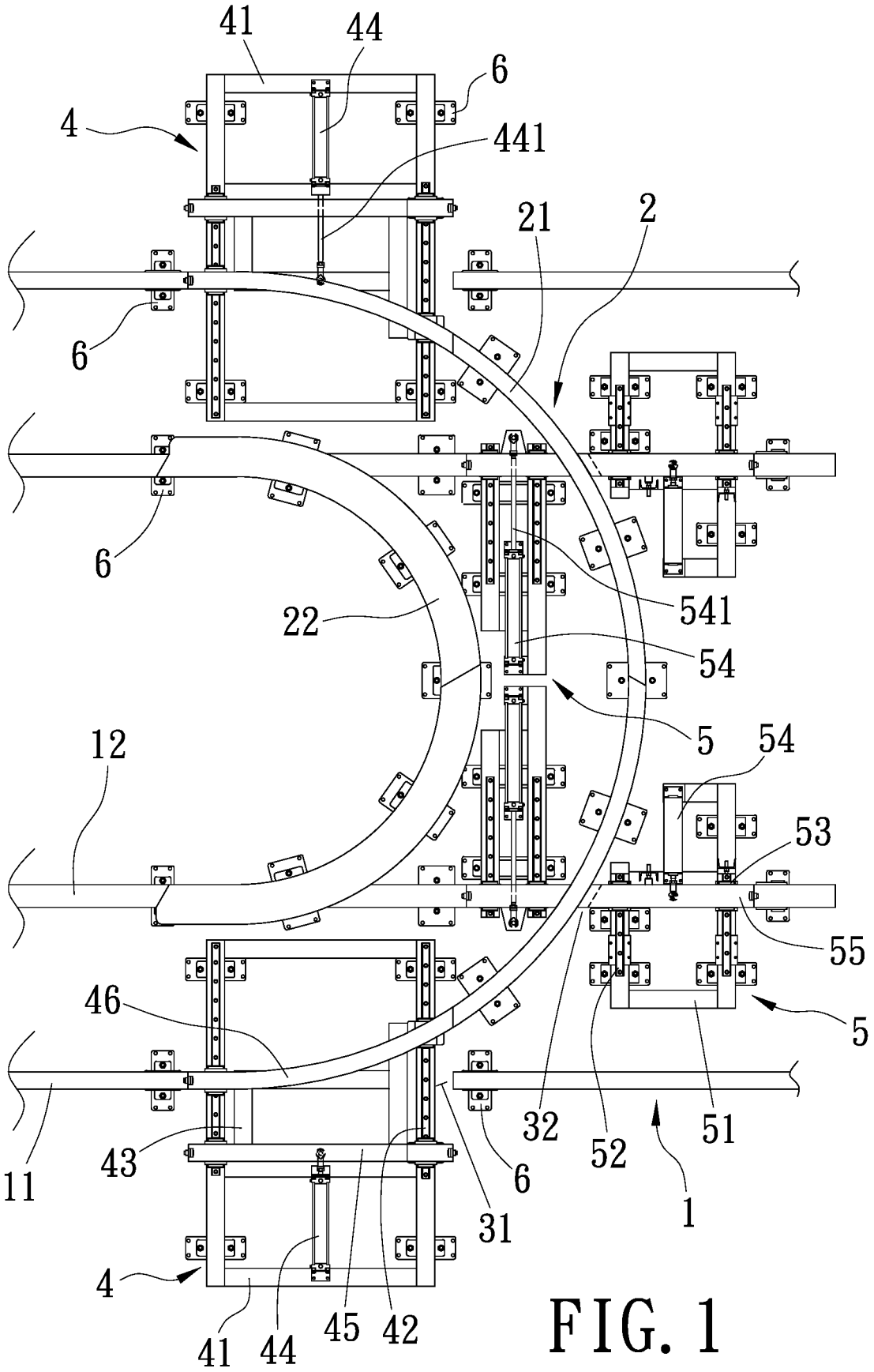
FIG. 1 is a top view showing a track switching apparatus for rail trolleys of the present invention.
Figure 3:
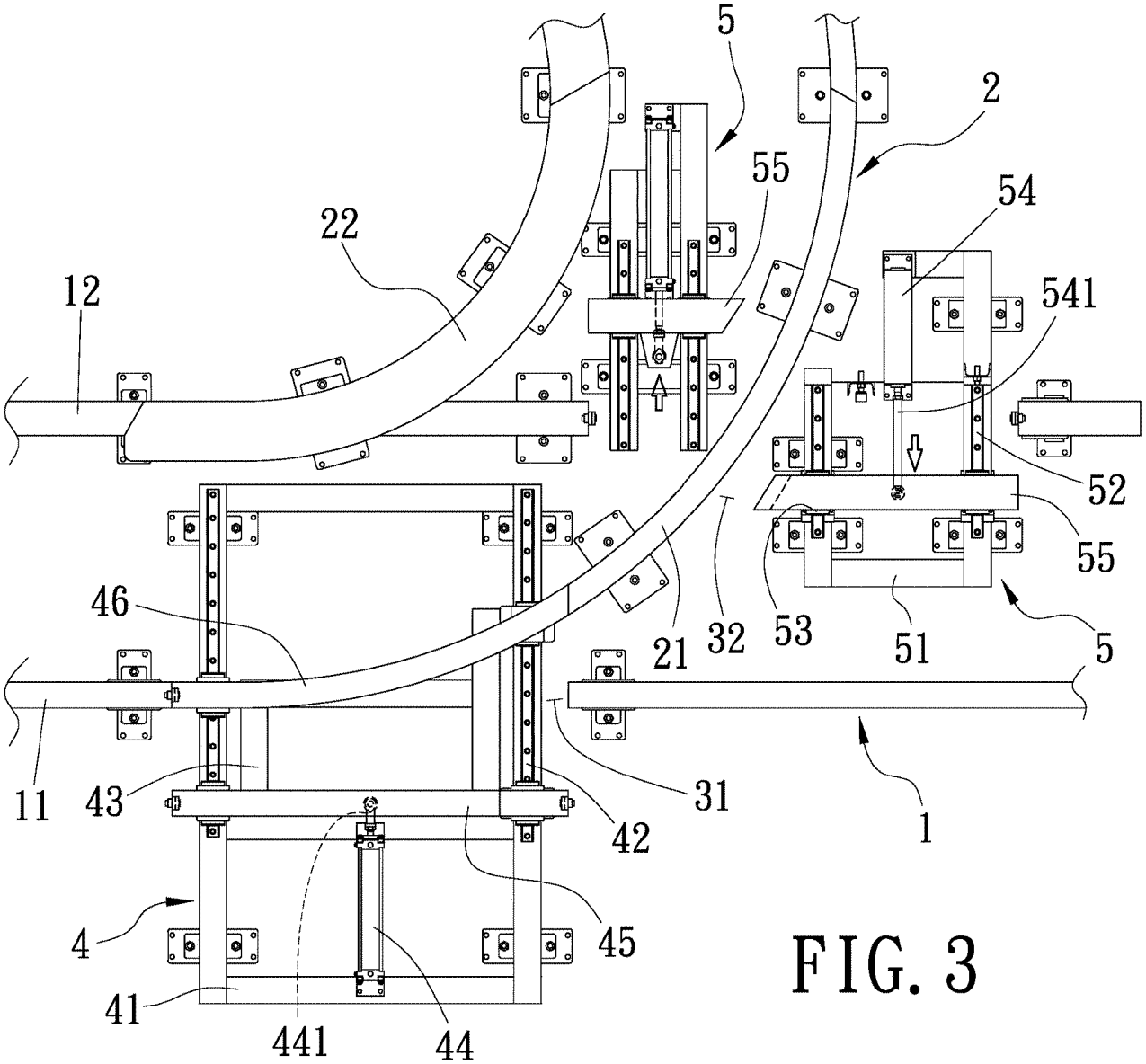
FIG. 3 is a schematic diagram showing a main track of the present invention in a switching state.

Referring to FIG. 1, the track switching apparatus for rail trolleys of the present invention mainly comprises at least one linear track (1) and a curved track (2). In a main embodiment of the present invention, the curved track (2) is disposed between two linear tracks (1) parallel to each other and connected to the two linear tracks (1) by two terminals of the curved track (2). The linear track (1) comprises a first power transmission rail strip (11) and a first supporting rail strip (12) parallel to the first power transmission rail strip (11). The curved track (2) comprises a second power transmission rail strip (21) and a second supporting rail strip (22) parallel to the second power transmission rail strip (21). A first switching region (31) is formed at a connection region of the first power transmission rail strip (11) of the linear track (1) and the second power transmission rail strip (21) of the curved track (2), and a first switching unit (4) is disposed in the first switching region (31). Referring to FIG. 1 and FIG. 3, at least one side of an intersection of the first supporting rail strip (12) of the linear track (1) and the second power transmission rail strip (21) of the curved track (2) is provided with a second switching region (32). In a main embodiment of the present invention, two sides of the intersection of the first support rail strip (12) of the linear track (1) and the second power transmission rail strip (21) of the curved track (2) are provided with two second switching regions (32) respectively, and each of the two second switching regions (32) is provided with a second switching unit (5).

The first switching unit (4) comprises a first base station (41) and at least one first sliding rail (42) disposed on the first base station (41). In a main embodiment of the present invention, two parallel first sliding rails (42) are provided. The first switching unit (4) further comprises a first sliding seat (43) disposed slidably on the first sliding rails (42), a first movement power source (44) disposed on the first base station (41), a first connection segment (45) having a linear shape and a second connection segment (46) having a curved shape. The first connection segment (45) and the second connection segment (46) are disposed at the first sliding seat (43) at an interval. The first connection segment (45) is for actively connecting to or separating from the first power transmission rail strip (11) of the linear track (1), and the second connection segment (46) is for actively connecting to or separating from the second power transmission rail strip (21) of the curved track (2). The first movement power source (44) can be a pneumatic cylinder, and the first movement power source (44) has a first transmission part (441) for connecting the first sliding seat (43).

The second switching unit (5) comprises a second base station (51) and at least one second linear sliding rail (52) disposed on the second base station (51). In a main embodiment of the present invention, two parallel second sliding rails (52) are provided. The second switching unit (5) further comprises a second sliding seat (53) disposed slidably on the second linear sliding rails (52), a second movement power source (54) disposed on the second base station (51) and a third connection segment (55) on the second sliding seat (53). The second movement power source (54) can be a pneumatic cylinder, and the second movement power source (54) has a second transmission part (541) for connecting the second sliding seat (53). The third connection segment (55) is for actively connecting to or separating from the first supporting rail strip (12) of the linear track (1).

Figure 2:
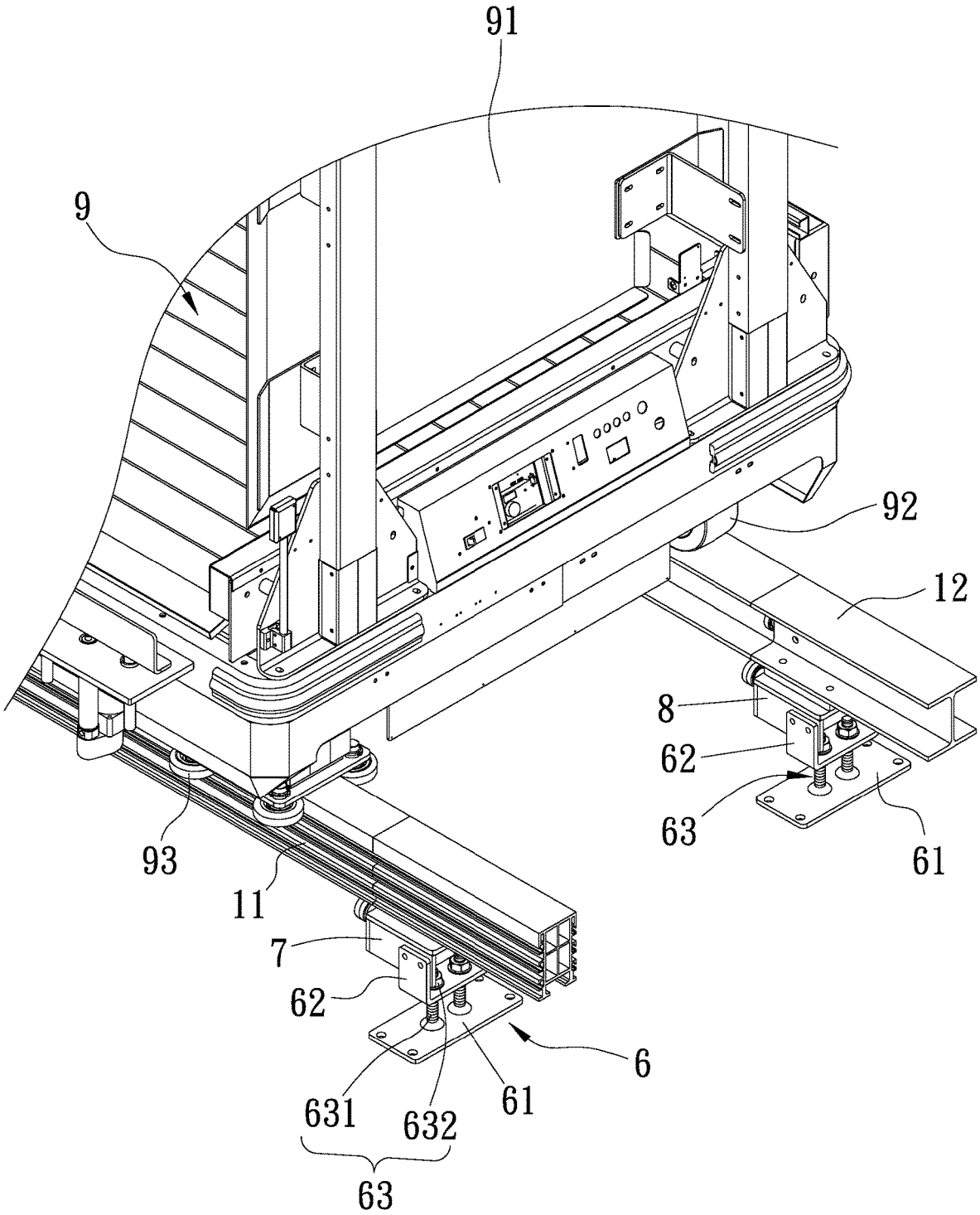
FIG. 2 is a schematic diagram showing a rail trolley installed on a track of the present invention.

Please referring to FIG. 2, the present invention further comprises plural stands (6). Each of the plural stands (6) has a base (61), an assembly seat (62) disposed on the base (61), and a lifting module (63) disposed between the base (61) and the assembly seat (62) for connection. The lifting module (63) comprises at least one screw (631) having one end fixed to the base (61) and at least one screw nut (632) for screwing to the at least one screw (631). The assembly seat (62) comprises at least one locking hole at a bottom for an insertion of the at least one screw (631), and the screw (631) is screwed to two screw nuts (632) for locking and fixing at an upper side and a lower side of the bottom of the assembly seat (62) respectively. The assembly seat (62) of each of the plural stands (6) is for connecting a bottom of each of the first power transmission rail strip (11) and the first supporting rail strip (12) of the linear track (1), a bottom of each of the second power transmission rail strip (21) and the second supporting rail strip (22) of the curved track (2), a bottom of the first base station (41) of the first switching unit (4) or a bottom of the second base station (51) of the second switching unit (5).

Figure 5:
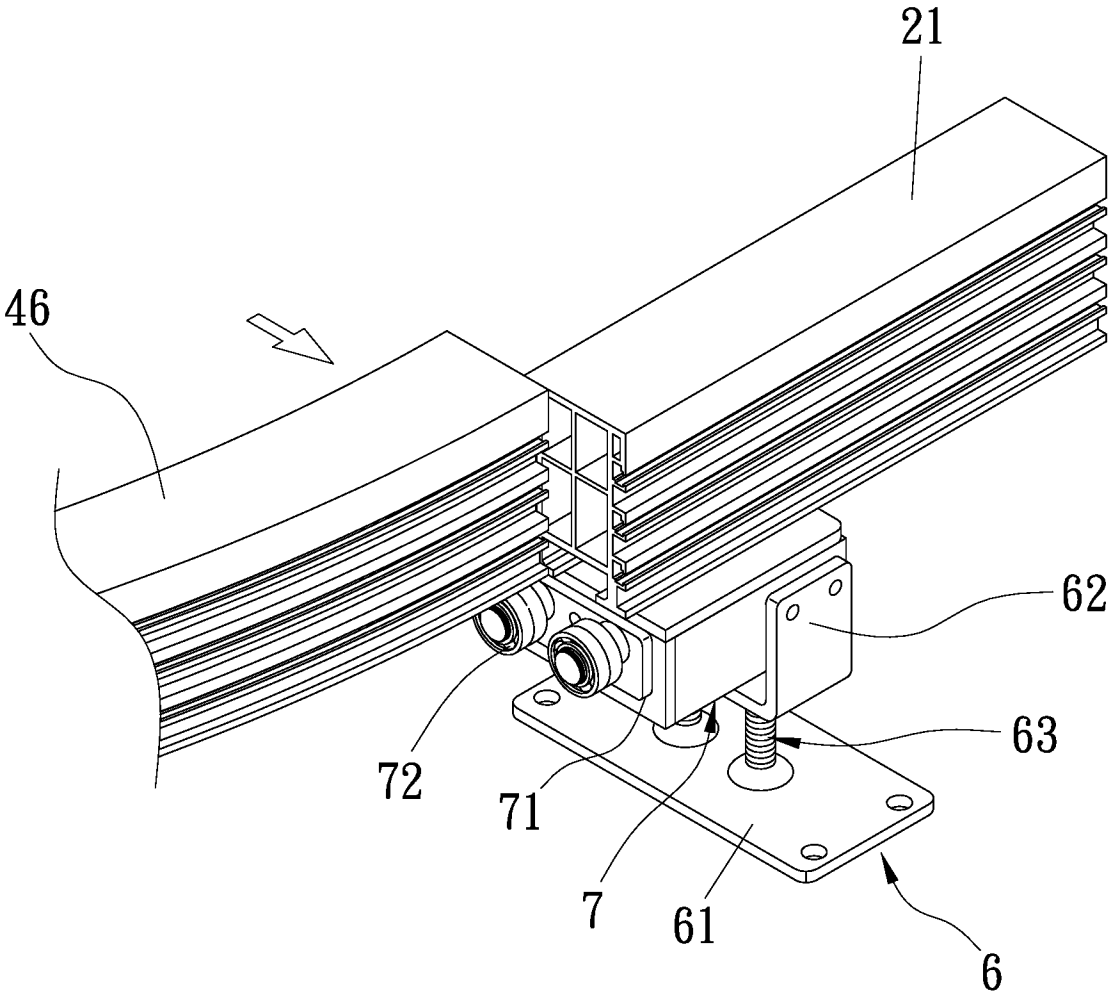
FIG. 5 is a schematic diagram showing a power transmission rail strip of the present invention in a connection state.

Referring to FIG. 5, the present invention further comprises plural second guide wheel assemblies (7). Each of the second guide wheel assemblies (7) comprises a second fixing seat (71) and at least one second sliding rail press reducing gear (72) disposed at one lateral of the second fixing seat (71). Each of an end bottom region of the first power transmission rail strip (11) and an end bottom region of the second power transmission rail strip (21) adjacent to the first switching region (31) is connected to one second fixing seat (71). The second fixing seat (71) is further connected to the assembly seat (62) of one stand (6) by a bottom thereof. The second sliding rail press reducing gear (72) disposed at the second fixing seat (71) is protruded from the first switching region (31) for attaching to or detaching from a bottom of the first connection segment (45); and the second sliding rail press reducing gear (72) connected to the end bottom region of the second power transmission rail strip (21) adjacent to the first switching region (31) is protruded from the first switching region (31) for attaching to or detaching from a bottom of the second connection segment (46).

Figure 6:
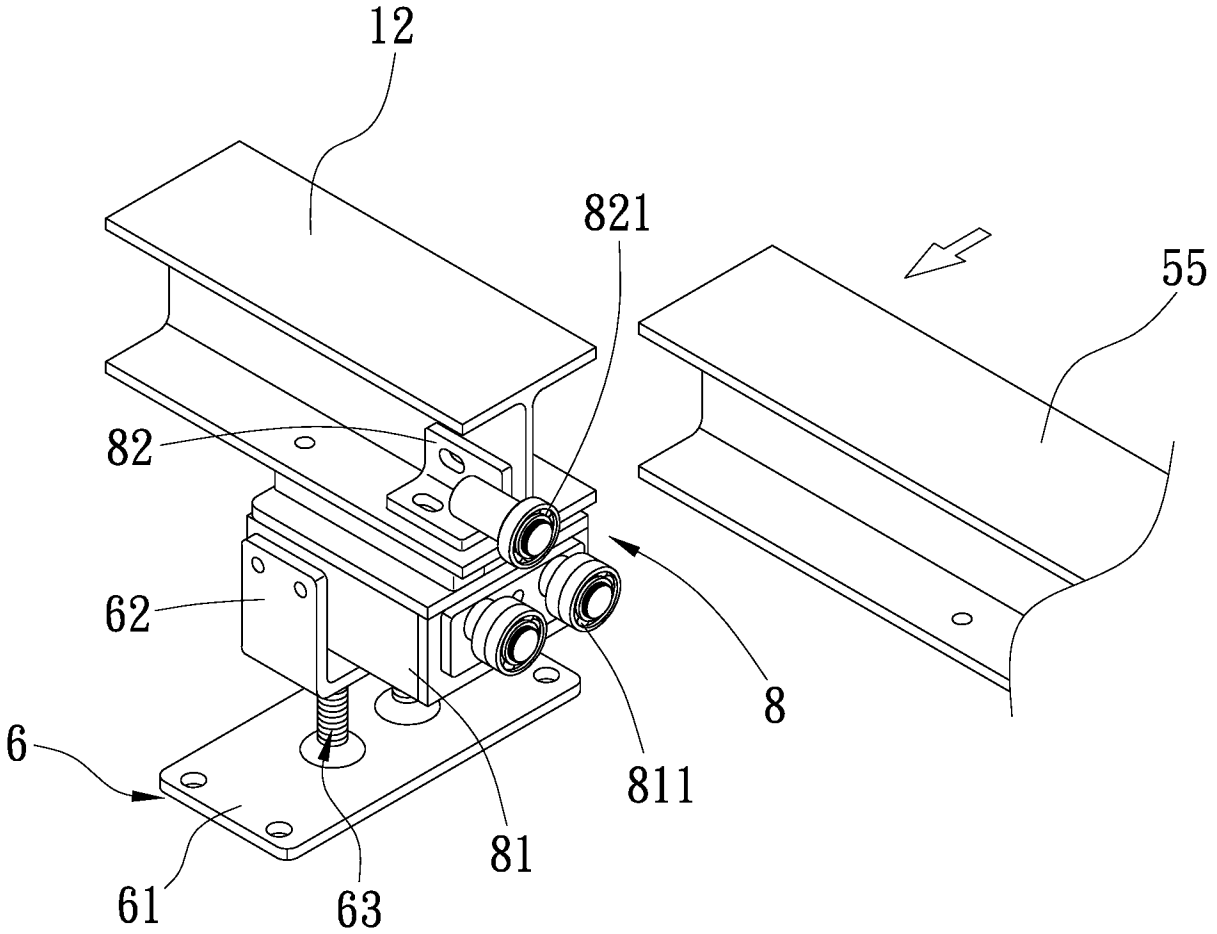
FIG. 6 is a first schematic diagram showing a third connection segment of the present invention in a connection state.

Referring to FIG. 1 and FIG. 6, the present invention further comprises plural first guide wheel assemblies (8). Each of the plural first guide wheel assemblies comprises a first fixing seat (81) and a positioning seat (82). The first fixing seat (81) is further provided with at least one first sliding rail press reducing gear (811) at one lateral thereof. Each of two end bottom regions of two first supporting rail strips (12) of the two linear tracks (1) adjacent to the two second switching regions (32) is connected to the first fixing seat (81), and a bottom of the first fixing seat (81) is connected to the assembly seat (62) of the stand (6). The first sliding rail press reducing gear (811) of the first fixing seat (81) is protruded from the second switching region (32) for attaching to or detaching from a bottom of the third connection segment (55). The positioning seat (82) is connected to an end lateral region of the first supporting rail strip (12) of the linear track (1) adjacent to the two second switching region (32), and the positioning seat (82) is further provided with a positioning wheel (821) disposed at one lateral thereof. The positioning wheel (821) is protruded from the second switching region (32) for attaching to or detaching from a lateral of the third connection segment (55).

Referring to FIG. 1 and FIG. 2, plural rail trolleys (9) are installed on a cargo transportation track comprising two linear tracks (1) and the curved track (2). The rail trolley (9) has a body (91), at least one wheel (92) disposed at a first lateral of the body (91) and plural conductive wheels (93) disposed at a second lateral of the body (91) corresponding to the first lateral. The at least one wheel (92) of the rail trolley (9) is contacted to a top end surface of the first supporting rail strip (12) of the linear track (1) and a top end surface of the second supporting rail strip (22) of the curved track (2). The plural conductive wheels (93) of the rail trolley (9) are disposed at and clipped two opposite laterals of the first power transmission rail strip (11) of the linear track (1) and two opposite laterals of the second power transmission rail strip (21) of the curved track (2). When the first power transmission rail strip (11) and the second power transmission rail strip (21) contacting to a collector terminal of the conductive wheel (93), electricity is transmitted to a driving device of the rail trolley (9) by the collector terminal for generating power and driving the at least one wheel (92) connected to the driving device to drive the rail trolley (9) to move on the cargo transportation track.

In a peak hour for cargo transportation, the curved track (2) is connected to two parallel linear tracks (1) by two terminals respectively, and the plural rail trolleys (9) are moved on the main track composed by the curved track (2) and the two linear tracks (1) for cargo transportation. Referring to FIG. 3, when the plural rail trolleys (9) are moved on the main track composed by the curved track (2) and the two linear tracks (1), the first movement power source (44) of the first switching unit (4) is actuated by a control unit signaling connected to the first switching unit (4), and the first sliding seat (43) is driven to move alone the first sliding rail (42) by the first movement power source (44) to move the curve-shaped second connection segment (46) disposed on the first sliding seat (43) to a corresponding connection position of the second power transmission rail (21) of the curved track (2) and form a complete curved track (2). The second movement power source (54) of each of the two second switching units (5) signaling connected to the control unit is further actuated to detach the third connection segment (55) disposed on the second sliding seat (53) from the first supporting rail strip (12) of the linear track (1), and the third connection segment (55) which intersects the second power transmission rail strip (21) of the curved track (2) is separated from the intersected position to prevent a collision interference situation between the conductive wheels (93) clipped at the two opposite laterals of the second transmission rail strip (21) of the curved track (2) and the third connection segment (55) when the rail trolley (9) is moving along the curved track (2). Therefore, the rail trolley (9) can transport cargos smoothly by moving on the main track comprising two linear tracks (1) and the curved track (2).

Figure 4:
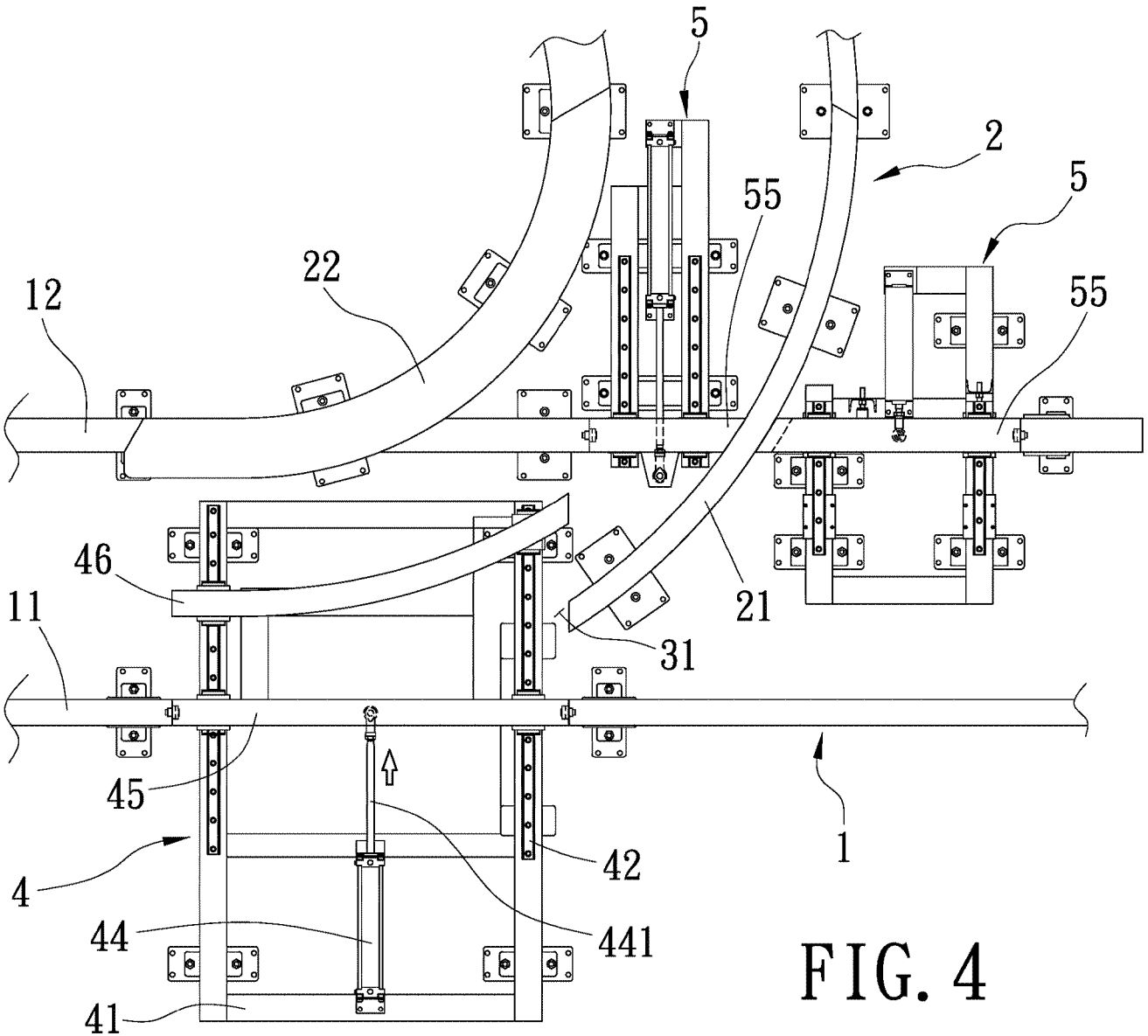
FIG. 4 is a schematic diagram showing a branch track of the present invention in a switching state.

In an off peak hour for cargo transportation, a number of the rail trolleys (9) on main track comprising the two linear tracks (1) and the curved track (2) needs to be reduced in response to decreasing of cargos to be transported. Referring to FIG. 4, the control unit transmits a signal to the first movement power source (44) of the first switching unit (4) to drive the first sliding seat (43) move alone the first sliding rail (42), so the first connection segment (45) having a linear shape is moved to a corresponding connection position of the first power transmission rail strip (11) of the linear track (1). Furthermore, the third connection segment (55) disposed on the second sliding seat (53) is moved to a corresponding connection position of the first supporting rail strip (12) of the linear track (1) by the second movement power source (54) driven by the control unit to form a complete linear track (1). Therefore, the rail trolley (9) is moved alone a branch track comprising the complete linear track (1) into a rest area for docking or a maintenance area for maintenance so as to reduce the number of rail trolleys (9) on the main track to a number required for the off peak hour and to provide less cargo transportation tasks and save electricity consumed by the rail trolleys (9).

Figure 7:
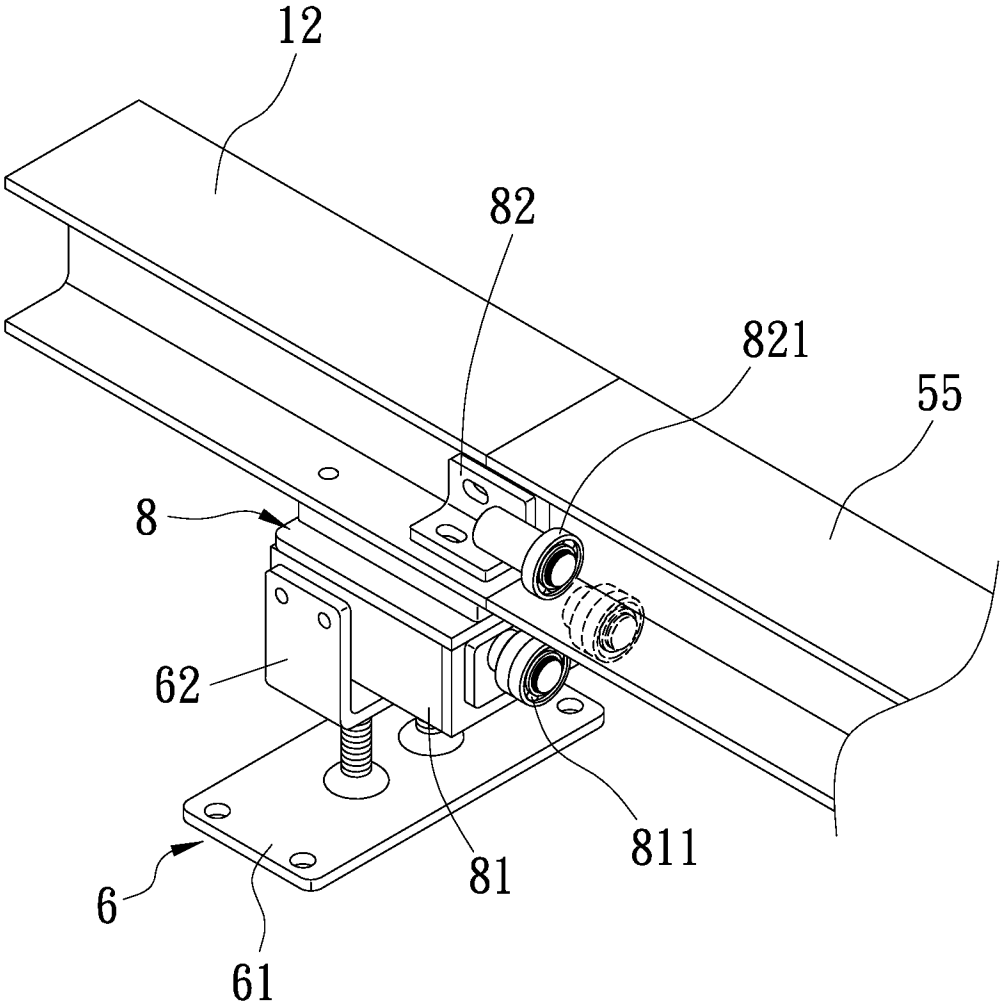
FIG. 7 is a second schematic diagram showing a third connection segment connected to a supporting rail strip of the present invention.

Referring to FIG. 5, when the first connection segment (45) disposed on the first sliding seat (43) is driven to connect to the first power transmission rail strip (11) of the linear track (1) by the first movement power source (44) of the first switching unit (4), or when the second connection segment (46) on the first sliding seat (43) is driven to connect the second power transmission rail strip (21) of the curved track (2) by the first movement power source (44) of the first switching unit (4), the second sliding rail press reducing gears (72) of the second guide wheel assembly (7) which are respectively disposed at two end bottom regions of the first power transmission rail strip (11) and two end bottom regions of the second power transmission rail trip (21) at the first switching region (31) provide orientations for connecting of the first connection segment (45) to the first power transmission rail strip (11) and connecting of the second connection segment (46) to the second power transmission rail strip (21) smoothly. In addition, supporting strength of a joint region between the first connection segment (45) and the first power transmission rail strip (11) and a joint region between the second connection segment (46) and the second power transmission rail strip (21) are also increased by the second sliding rail press reducing gears (72) of the second guide wheel assembly (7) so as to increase moving stability of the rail trolleys (9) on the cargo transportation track. Referring to FIG. 6, when the third connection segment (55) disposed on the second sliding seat (53) is driven to connect to the first supporting rail strip (12) by the second movement power source (54) of the second switching unit (5), the first sliding rail press reducing gear (811) of the first fixing seat (81) disposed at the end bottom regions of the first supporting rail strip (12) at the second switching region (32) provides orientations for connecting of the third connection segment (55) to the first supporting rail strip (12) smoothly. A supporting strength of a joint region between the third connection segment (55) and the first supporting rail strip (12) is also increased by the first sliding rail press reducing gear (811) of the first fixing seat (81) so as to increase moving stability of the rail trolleys (9) on the cargo transportation track. Referring to FIG. 7, the positioning wheel (821) of the positioning seat (82) disposed at the end lateral region of the first supporting rail strip (12) at the second switching region (32) is contacted and positioned to a lateral surface of the third connection segment (55) for increasing connection accuracy of the third connection segment (55) to the first supporting rail strip (12).

The screw nuts (632) screwed on the screw (631) of the lifting module (63) can be loosen to adjust the assembly seat (62) up and down for adjusting height of the assembly seat (62). After the height of the assembly seat (62) is regulated to a required height, the screw nuts (632) are re-screwed to the screw (631) for fixing the assembly seat (62). Therefore, referring to FIG. 1 and FIG. 2, the assembly seat (62) of the stand (6) provided to a bottom of each of the first power transmission rail strip (11), the first supporting rail strip (12), the second power transmission rail strip (21), the second supporting rail strip (22), the first base station (41) of the first switching unit (4) and the second base stand (51) of the second switching unit (5) can regulate a top surface of each of the first power transmission rail strip (11), the first supporting rail strip (12), the second power transmission rail strip (21), the second supporting rail strip (22), the first connection segment (45), the second connection segment (46) and the third connection segment (55) to a same horizontal position for ensuring safety and stability of the rail trolleys (9) moving on the cargo transportation track built on a rugged ground of the factory building.

What is claimed is:

1. A track switching apparatus for rail trolleys, comprising:

at least one linear track having a first power transmission rail strip and a first supporting rail strip parallel to the first power transmission rail strip;

a curved track connected to the at least one linear track and having a second power transmission rail strip and a second supporting rail strip parallel to the second power transmission rail strip;

a first switching region formed at a connection region of the first power transmission rail strip of the linear track and the second power transmission rail strip of the curved track;

a first switching unit disposed in the first switching region and having a first base station, at least one first sliding rail disposed on the first base station, a first sliding seat disposed slidably on the at least one first sliding rail, a first movement power source disposed on the first base station and having a first transmission part connected to the first sliding seat, a first connection segment having a linear shape for actively connecting to or separating from the first power transmission rail strip of the linear track, and a second connection segment having a curved shape disposed on the first sliding seat at an interval for actively connecting to or separating from the second power transmission rail strip of the curved track; and plural first guide wheel assemblies and each of which has a first fixing seat and connects to an end bottom region of the first supporting rail strip of the linear track adjacent to a second switching region, wherein at least one side of an intersection of the first supporting rail strip of the linear track and the second power transmission rail strip of the curved track is provided with the second switching region, wherein the second switching region is further provided with a second switching unit having a second base station, at least one second linear sliding rail disposed on the second base station, a second sliding seat disposed slidably on the at least one second linear sliding rail, a second movement power source disposed on the second base station and having a second transmission part connected to the second sliding seat, and a third connection segment on the second sliding seat for actively connecting to or separating from the first supporting rail strip of the linear track, wherein the first fixing seat of each of the plural first guide wheel assemblies is further provided with a stand at a bottom thereof and at least one first sliding rail press reducing gear disposed at one lateral thereof and protruded from the second switching region for attaching to or detaching from a bottom of the third connection segment.

2. The track switching apparatus for rail trolleys as claimed in claim 1, wherein each of the two sides of the intersection of the first support rail strip of the linear track and the second power transmission rail strip of the curved track is provided with one of two second switching regions respectively, and each of the two second switching regions is provided with the second switching unit.

3. The track switching apparatus for rail trolleys as claimed in claim 1, wherein each of the plural first guide wheel assemblies is further provided with a positioning seat connected to an end lateral region of the first supporting rail strip of the linear track adjacent to the second switching region, and wherein the positioning seat of each of the plural first guide wheel assemblies is further provided with a positioning wheel disposed at one lateral thereof and protruded from the second switching region for attaching to or detaching from a lateral of the third connection segment.

4. The track switching apparatus for rail trolleys as claimed in claim 1, further comprising plural stands and each of which has a base, an assembly seat disposed on the base, and a lifting module disposed between the base and the assembly seat for connection, and wherein the assembly seat of each of the plural stands is for connecting a bottom of each of the first power transmission rail strip and the first supporting rail strip of the linear track, the second power transmission rail strip and the second supporting rail strip of the curved track, the first base station of the first switching unit or the second base station of the second switching unit.

5. The track switching apparatus for rail trolleys as claimed in claim 4, wherein the lifting module of the stand comprises at least one screw having one end fixed to the base and at least one screw nut for screwing to the at least one screw, wherein the assembly seat comprises at least one locking hole at a bottom thereof for an insertion of the at least one screw, and wherein each of the at least one screw is screwed to two screw nuts for locking and fixing at an upper side and a lower side of the bottom of the assembly seat respectively.

6. The track switching apparatus for rail trolleys as claimed in claim 1, further comprising plural stands, each of which has a base, an assembly seat disposed on the base, and a lifting module disposed between the base and the assembly seat for connection, and wherein the assembly seat of each of the plural stands is respectively connected to a bottom of each of the first power transmission rail strip and the first supporting rail strip of the linear track, the second power transmission rail strip and the second supporting rail strip of the curved track and the first base station of the first switching unit.

7. The track switching apparatus for rail trolleys as claimed in claim 6, wherein the lifting module of the stand comprises at least one screw having one end fixed to the base and at least one screw nut for screwing to the at least one screw, wherein the assembly seat comprises at least one locking hole at a bottom thereof for an insertion of the at least one screw, and wherein each of the at least one screw is screwed to two screw nuts for locking and fixing at an upper side and a lower side of the bottom of the assembly seat respectively.

8. The track switching apparatus for rail trolleys as claimed in claim 1, wherein the curved track is disposed between two linear tracks parallel to each other and connected to the two linear tracks by two terminals thereof.

9. A track switching apparatus for rail trolleys, comprising:

at least one linear track having a first power transmission rail strip and a first supporting rail strip parallel to the first power transmission rail strip;

a curved track connected to the at least one linear track and having a second power transmission rail strip and a second supporting rail strip parallel to the second power transmission rail strip;

a first switching region formed at a connection region of the first power transmission rail strip of the linear track and the second power transmission rail strip of the curved track;

a first switching unit disposed in the first switching region and having a first base station, at least one first sliding rail disposed on the first base station, a first sliding seat disposed slidably on the at least one first sliding rail, a first movement power source disposed on the first base station and having a first transmission part connected to the first sliding seat, a first connection segment having a linear shape for actively connecting to or separating from the first power transmission rail strip of the linear track, and a second connection segment having a curved shape disposed on the first sliding seat at an interval for actively connecting to or separating from the second power transmission rail strip of the curved track; and plural second guide wheel assemblies and each of which has a second fixing seat and at least one second sliding rail press reducing gear disposed at one lateral of the second fixing seat and protruded from the first switching region for attaching to or detaching from a bottom of the first connection segment or a bottom of the second connection segment, wherein each of an end bottom region of the first power transmission rail strip and an end bottom region of the second power transmission rail strip is connected to the second fixing seat, and wherein the second fixing seat of each of the plural second guide wheel assemblies is further provided with a stand at a bottom thereof.

* * * * *